US005461216A

United States Patent [19]

McDonald

[11] Patent Number: 5,461,216

[45] Date of Patent: Oct. 24, 1995

[54] SINGLE LAYER, GREASEPROOF, FLEXIBLE PAPER POPCORN PACKAGE

[75] Inventor: Duane L. McDonald, Neenah, Wis.

[73] Assignee: General Mills, Inc., Minneapolis, Minn.

[21] Appl. No.: 281,730

[22] Filed: Jul. 28, 1994

[51] Int. Cl.[6] ..... H05B 6/80

[52] U.S. Cl. ..... 219/727; 219/730; 426/107; 426/234; 99/DIG. 14

[58] Field of Search ..... 219/727, 730, 219/759, 735, 725; 426/107, 110, 111, 113, 123, 234, 241, 243; 99/DIG. 14; 229/903

[56] References Cited

U.S. PATENT DOCUMENTS

| | | | |
|---|---|---|---|
| 3,023,947 | 3/1962 | McDuffie . | |
| 4,036,423 | 7/1977 | Gordon | 426/111 |
| 4,038,425 | 7/1977 | Brandberg et al. . | |
| 4,190,757 | 2/1980 | Turpin et al. . | |
| 4,260,101 | 4/1981 | Webinger | 219/10.55 E |
| 4,266,108 | 5/1981 | Anderson et al. . | |
| 4,267,420 | 5/1981 | Brastad | 525/305 |
| 4,281,083 | 7/1981 | Arbit | 99/DIG. 14 |
| 4,283,417 | 8/1981 | Winters et al. . | |
| 4,292,332 | 9/1981 | McHam . | |
| 4,518,651 | 5/1985 | Wolfe, Jr. | 219/10.55 E |
| 4,553,010 | 11/1985 | Bohrer et al. | 219/10.55 E |
| 4,571,337 | 2/1986 | Cage et al. | 426/107 |
| 4,596,713 | 6/1986 | Burdette | 426/107 |
| 4,691,374 | 9/1987 | Watkins et al. | 426/107 |
| 4,775,771 | 10/1988 | Powlowski et al. | 219/10.55 E |
| 4,808,421 | 2/1989 | Mendenhall et al. | 426/107 |
| 4,810,844 | 3/1989 | Anderson | 219/10.55 E |
| 4,864,090 | 9/1989 | Maxwell et al. | 219/10.55 E |
| 4,890,439 | 1/1990 | Smart et al. | 219/727 |
| 4,892,744 | 1/1990 | Ylvisaker . | |
| 4,904,488 | 2/1990 | La Baw et al. | 426/107 |
| 4,950,859 | 8/1990 | Anderson | 219/10.55 E |
| 4,973,810 | 11/1990 | Brauner | 219/10.55 E |
| 5,006,405 | 4/1991 | Watkins et al. . | |
| 5,008,024 | 4/1991 | Watkins . | |
| 5,011,299 | 4/1991 | Black, Jr. et al. | 219/10.55 E |
| 5,044,777 | 9/1991 | Watkins et al. | 383/100 |
| 5,171,950 | 12/1992 | Brauner et al. | 219/727 |

FOREIGN PATENT DOCUMENTS

92/22475 12/1992 WIPO .

OTHER PUBLICATIONS

Database WPI, Week 8034, 5 Aug. 1980, Derwent Publications Ltd., London, GB; AN 80-58795C & CA,A, 1 082 859 (Domtar Inc.) 5 Aug. 1980.

*Primary Examiner*—Philip H. Leung

*Attorney, Agent, or Firm*—L. MeRoy Lillehaugen; John A. O'Toole; Alan D. Kamrath

[57] ABSTRACT

A package for use in microwave ovens is disclosed in its preferred form of a flexible, tubular bag (18) including expandable side walls (26) interconnected between bottom and top walls (20, 22), an openable end (28), and a permanent end wall (24). The side walls (26) include pleats (**26*a*, 26*b*, 26*c*, 26*d*) which are folded in a collapsed condition of the bag (18) and expand due to internal expansion forces generated by the popping of kernels and the creation of water vapor. In a preferred form, the bag (18) is formed from a single layer of flexible, greaseproof paper of highly refined raw fibers of 100% chemical softwood pulp and having a basis weight in the order of 35 lb./ream. The single layer of paper forming the bag (18) provides greaseproof properties in storage, transportation, and cooking throughout the thickness of the paper to prevent wicking and leaking of grease or oil through the single layer. The bag (18) in a preferred form includes grease protectors (42*a*, 42*b*, 42*c*, 42*d*) located inside of the bag (18) for sealing the bottom and top walls (20, 22) to the pleats (26*a*, 26*b*, 26*c*, 26*d*) adjacent to their respective connecting edges and in a most preferred form further includes grease protectors (44*a*, 44*b*) outside of the bag (18) for sealing the first and second pleats (26*a*, 26*b*) together and the third and fourth pleats (26*c*, 26*d*) together adjacent to their respective connecting edges. The grease protectors (42*a*, 42*b*, 42*c*, 42*d*, 44*a*, 44*b*) seal the surfaces of the bag (18) just above and adjacent the connecting edges to block the flow of grease to prevent grease wicking or leaking from the bag (18**).

22 Claims, 4 Drawing Sheets

SINGLE LAYER, GREASEPROOF, FLEXIBLE PAPER POPCORN PACKAGE

CROSS REFERENCE

The present application is a continuation of international application No. PCT/US 93/00849 filed Jan. 29, 1993 which is a continuation of U.S. application Ser. No. 07/834,185 filed Feb. 6, 1992, now abandoned.

BACKGROUND

The present invention relates generally to packages for use in microwave ovens, and pertains more particularly to an expandable bag having protection from grease leaking and/or wicking from its expansion creases or folds and/or to a flexible popcorn package made from a single layer of greaseproof paper.

When microwave popcorn packages were first introduced utilizing a microwave susceptor, the packages typically were formed by expandable paperboard containers and often the load of the microwave popcorn popping package was located in a plastic bag positioned inside of the paperboard container including the microwave susceptor. The paperboard container in most instances was unfolded into an expanded size by the consumer prior to popping of the popcorn kernels in the microwave oven but in some instances was unfolded by the popping of the popcorn kernels, with the popped popcorn being served in the expanded paperboard containers. Early packages suffered from several disadvantages including the bulk of expandable paperboard containers which increased the amount of material required to make the container and thus its cost, increased the size of the packaging and storage requirements, as well as increased the amount of material which had to be disposed of after the consumption of the popcorn raising environmental concerns. Further, the dynamics of expanding the paperboard container and/or plastic bag by the forces generated while popping the kernels were typically insufficient to maximize the volume of the package which in turn prevented the popcorn from popping with greater volume. Also, plastic bags are susceptible to melting and often are difficult to handle with a hot food product at least due to the poor insulating qualities of plastic. To avoid these and other problems and with the development of microwave susceptors applied in the form of a thin coating such as disclosed in U.S. Pat. No. 4,267,420 issued to William A. Brastad, the microwave popcorn industry has turned to popcorn packages formed from flexible paper bags.

However, paper microwave popcorn popping bags including microwave susceptors encountered different types of problems. For example, the load of a microwave popcorn popping package includes unpopped popcorn kernels, a cooking oil or grease, salt, and other ingredients such as colorings, flavorings, or the like. It can be appreciated that during storage or transportation of the filled microwave popcorn package by the processor, the marketing agencies, and the consumer, the oil and/or grease have a tendency to leak from flexible paper packages, especially at high temperatures, causing aesthetically unpleasant appearances. Further, during microwave popping, the oil and/or grease have a tendency to wick from flexible paper packages. Current flexible paper popcorn bags such as disclosed in U.S. Pat. No. 5,044,777 typically use a tri-laminate of a greaseproof paper adhered to an outer fluorocarbon treated, grease resistant paper with a microwave susceptor sandwiched between. For example, the inner layer could be formed of bleached greaseproof Kraft paper of 11.5 kg. (25 lb.)/ream basis weight and the outer layer could be formed of plain bleached Kraft paper of 13.5 kg. (30 lb.)/ream basis weight. The two paper layers and the adhesive therebetween together provide the needed grease barrier in both storage and/or transportation at high temperatures as well as during microwave cooking. However, laminated paper popcorn bags suffer from several disadvantages. First, the paper bag has a great deal of stiffness resulting from the multiple layers themselves but also their adhesive interconnection. Stiffness detracts from the ability of the bag to inflate or expand during microwave popping of the popcorn which may in turn detrimentally affect the volume of the popped kernels. Also, the lamination of the materials requires extra assembly costs and the amount of materials used for each bag adds to the economic and environmental costs.

Thus, there is a need to reduce the amount of material and/or layers utilized in the formation of flexible paper popcorn packages including a microwave susceptor. Current efforts in single ply paper bags which have been unsuccessful prior to the present invention involve common greaseproof paper in combination with surface coatings of fluorocarbons, such as FC-807 made by 3M, Inc., St. Paul, Minn., or equivalent. However, such efforts have not resulted in commercially successful packages as they do not provide adequate greaseproof properties in storage, transportation, or cooking throughout the paper. Further, when this paper is creased such as at the corners in the pleats and between the pleats and the top and bottom walls, fibers in the paper and the coatings applied thereto fracture and separate and reveal Uncoated fiber ends which absorb grease. Moreover, breaks or fractures might occur and the oil and/or grease can leak out of the package.

Consequently, there is a continuing need for a flexible paper popcorn package with reduced layers and particularly formed of a single layer of flexible paper.

Further, as set forth above, the problem of grease wicking and actual leaking is especially present at folds and creases where the fibers of the paper and coatings applied thereto for the greaseproofing characteristics are fractured and/or separated. This problem has been one of the major factors in limiting the amount that the material and/or number of layers can be reduced in flexible paper popcorn bags, as the mass and number of layers of material are relied upon to provide the needed grease barrier. Thus, a need exists for optionally providing an added grease barrier at only those locations especially at folds and creases where grease wicking and leaking are a problem, with the added grease barrier allowing minimization of the material and/or number of layers at the remaining locations where grease wicking and leaking are not such a problem.

Surprisingly, the above needs and other objectives can be satisfied by providing a package in the form of a bag including grease protectors for sealing the surfaces of the walls of the bag adjacent to their connecting, folding edges to prevent the grease or oil from leaking or wicking from the interior volume of the bag.

In a preferred aspect, the package includes pleated, expandable side walls, with the grease protectors located inside of the bag where the inside surfaces of the pleats overlie other inside surfaces of the bag and also located outside of the bag where the outside surfaces of the pleats overlie other outside surfaces of the bag.

In yet another preferred aspect of the present invention, the bag holds popcorn kernels and grease or oil for popping in a microwave oven, with the bag formed of a single layer of greaseproof paper having a thickness allowing the single layer to be flexed by the popping of the popcorn kernels and also preventing the wicking and leaking of the grease or oil through the single layer.

The present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where:

FIG. 1 shows a perspective view of a package fabricated in accordance with the preferred teachings of the present invention in generally its collapsed, storage condition, but illustrated slightly expanded to show constructional details.

Figure 2:
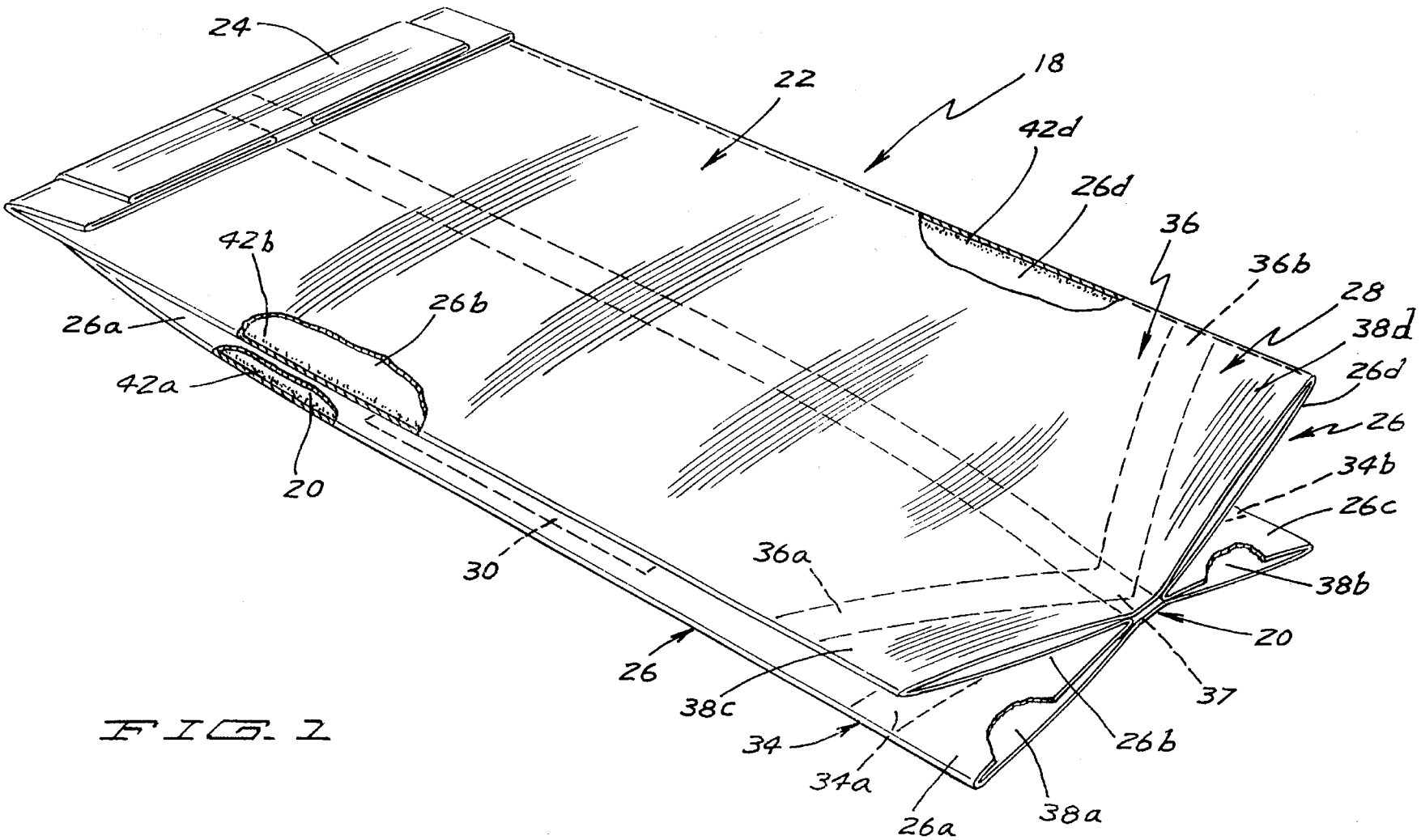
FIG. 2 shows a top plan view of the package of FIG. 1, with portions broken away to show constructional details.
Figure 2:
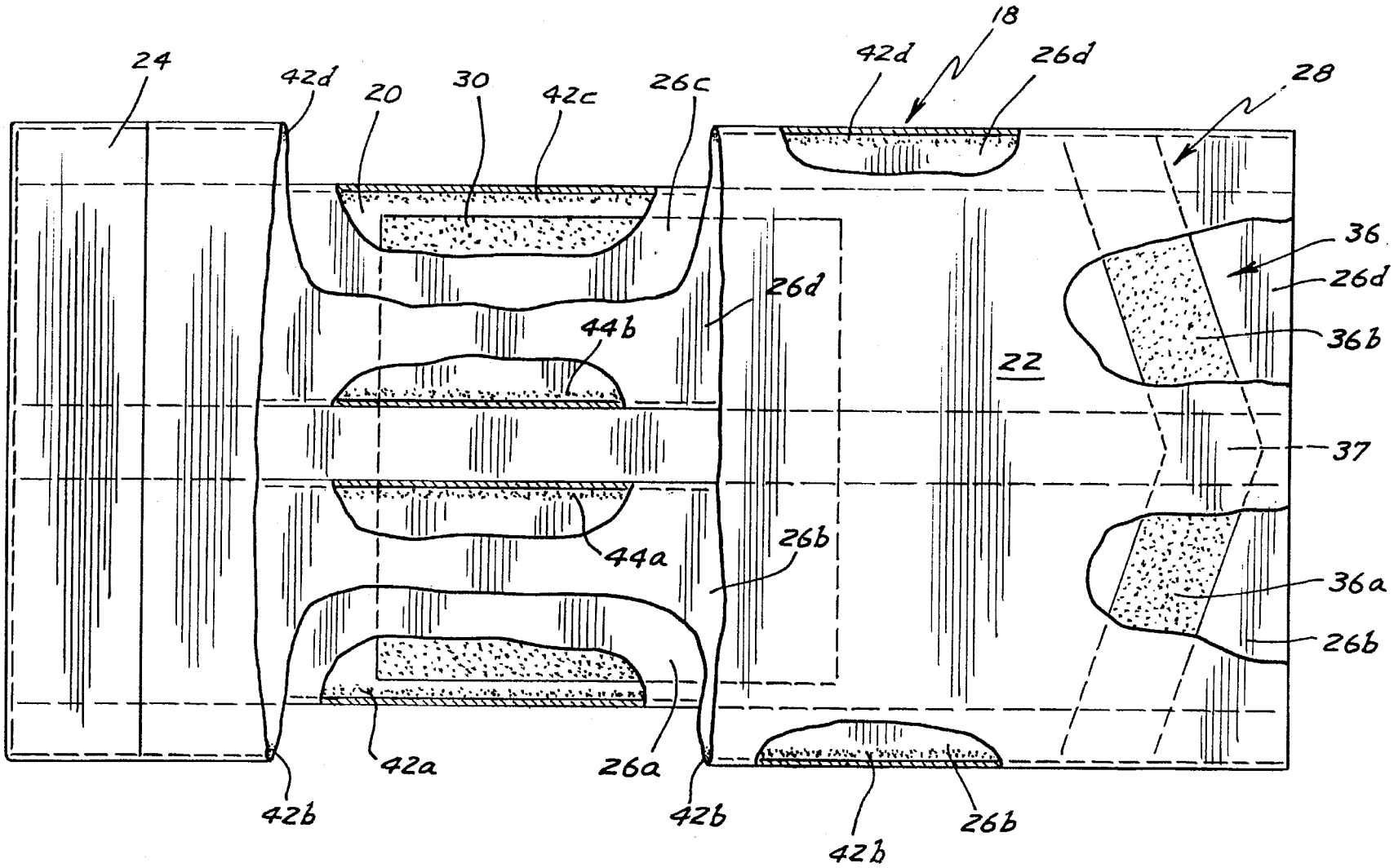

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

A package for use in microwave ovens according to the preferred teachings of the present invention is shown as an expandable, flexible bag in the drawings and generally designated 18. It will facilitate the ensuing description to consider bag 18 in the horizontal position when placed in the microwave oven as opposed to a vertical or upright position when the contents of bag 18 are being consumed by the consumer. Therefore, bag 18 includes a bottom wall 20, a top wall 22, an end wall 24, side walls 26 and a closed end 28. In the preferred form, the width of bottom wall 20 is less than the width of top wall 22, although the widths of walls 20 and 22 could be equal.

End wall 24 provides a non-opening permanent seal to the first end of bag 18. Particularly, the cross sectional makeup of end wall 24 includes a number of folds that are not important to an understanding of the present invention so will not be specifically described, although end wall 24 should be constructed so as to seal adequately the vapor created within bag 18 during the heating thereof in the microwave oven. In the preferred form of the present invention, end wall 24 is shown as being of the type shown in U.S. Pat. No. 4,973,810 and is formed by folding the first ends of bottom, top, and side walls 20, 22, and 26 over top wall 22. Alternatively, end wall 24 can have a flat rectangular or square configuration, with such bags being commonly referred to as square bottom bags in the trade. Further, bag 18 can optionally include the non-heated flap of the type shown and described in U.S. Pat. No. 4,864,090. However, it should be appreciated that end wall 24 can be a variety of types and configurations such as but not limited to the types shown in U.S. Pat. Nos. 3,973,045; 4,450,180; 4,691,374; and 5,044,777.

In the most preferred form, side walls 26 include gussets or pleats **26*a*, 26*b*, 26*c* and 26*d* that enable side walls 26 to expand during a heating cycle. Particularly, in the preferred form, pleats 26*a* and 26*b* are connected together at first edges and have second and third, opposite edges connected to bottom wall 20 and top wall 22, respectively. Likewise, pleats 26*c* and 26*d* are connected together at fourth edges and have fifth and sixth, opposite edges connected to bottom wall 20 and top wall 22, respectively. In the preferred form, in its collapsed condition, pleats 26*a* and 26*c* have the same width and overlie bottom wall 20, and pleats 26*b* and 26*d* have the same width which is greater than the width of pleats 26*a* and 26*c* and overlie pleats 26*a* and 26*c*, with top wall 22 overlying pleats 26*b* and 26*d*. In the preferred form, bottom and top walls 20 and 22 have a width extending beyond the interconnections of pleats 26*a* and 26*b* and of pleats 26*c* and 26*d* when bag 18 is in its collapsed condition. The second, free ends of pleats 26*a*, 26*b*, 26*c* and 26*d* forming side walls 26, of bottom wall 20, and of top wall 22 are co-planar, and have the same extent or length from end wall 24**.

End 28 provides a peelable closure seal which fails during microwave cooking adjacent the second, free ends of bottom, top and side walls 20, 22, and 26 or in other words, adjacent the second end of bag 18. This peelable seal failure allows trapped steam to vent from the package, as well as allowing the consumer to open bag 18 after microwave cooking and prior to eating. In the most preferred form, end 28 is formed in a manner as shown and described in U.S. Pat. No. 5,189,272, which is hereby incorporated herein by reference, and includes first and second v-shaped adhesive strips 34 and 36. Strip 34 is located on bottom wall 20 having first and second, straight legs **34*a* and 34*b* interconnected by their first ends at an angle in the order of 140° and having their second ends extending to the interconnection of pleats 26*a* and 26*c* to bottom wall 20, respectively. Strip 36 overlies strip 34 and is located on top wall 22 having first and second, straight legs 36*a* and 36*b* interconnected by their first ends at an angle in the order of 140° and having their second ends extending to the interconnection of pleats 26*b* and 26*d* to top wall 22, respectively. The distance or spacing of the second ends of legs 34*a*, 34*b*, 36*a*, and 36*b* from the second, free ends of walls 20, 22, and 26 is greater than the distance or spacing of the first ends and intersections of legs 34*a*, 34*b*, 36*a*, and 36*b* from the second, free ends of walls 20, 22, and 26. It can then be appreciated that leg 34*a* adheres and seals pleat 26*a* to bottom wall 20, leg 34*b* adheres and seals pleat 26*c* to bottom wall 20, leg 36*a* adheres and seals pleat 26*b* to top wall 22, and leg 36*b* adheres and seals pleat 26*d* to top wall 22. Further, strips 34 and 36 adhere and seal bottom wall 20 to top wall 22 at their central portions 37 intermediate the interconnections of pleats 26*a* and 26*b* and of pleats 26*c* and 26*d***.

Areas 38*a*, 38*b*, 38*c* and 38*d* are formed and defined by the material between the free ends of walls 20, 22, and 26 and strips 34 and 36 and located on the opposite side of strips 34 and 36 forming the peelable seal than end 24, with areas 38*a*, 38*b*, 38*c*, and 38*d* being free of adhesive and unsealed in the preferred form. Due to the angular orientation of legs 34*a*, 34*b*, 36*a*, and 36*b*, areas 38*a*, 38*b*, 38*c*, and 38*d* are of a triangular configuration. Further, since the first ends of legs 34*a*, 34*b*, 36*a*, and 36*b* are located in the central portions 37 of bottom and top walls 20 and 22 having widths extending beyond pleats 26*a*, 26*b*, 26*c*, and 26*d* and since legs 34*a*, 34*b*, 36*a* and 36*b* extend therefrom in a linear manner at an obtuse angle to the opposite edges of pleats 26*a*, 26*b*, 26*c*, and 26*d*, areas 38*a*, 38*b*, 38*c*, and 38*d* are of a large size for grasping by the consumer and specifically are considerably larger than flaps formed by adhesive extending at small angles relative to each other and only through the pleats such as when a box-like shape is desired as disclosed in U.S. Pat. No. 5,044,777.

However, it should be appreciated that end 28 can be a variety of types and configurations according to preferred aspects of the present invention such as but not limited to the types shown in U.S. Pat. Nos. 3,973,045; 4,450,180; 4,691,374; 4,864,090; 4,973,810; and 5,044,777.

Attention is now directed to a susceptor pad 30 that extends over a portion of bottom wall 20 spaced from end wall 24 and end 28. Susceptor pad 30 can be formed in any suitable manner known in the art such as a metalized plastic film adhered to bottom wall 20, as a paper backed susceptor, or as a coating applied or printed to bottom wall 20. Further, although susceptor pad 30 is shown as overlying bottom wall 20 and thus located inside of bag 18, susceptor pad 30 can be located outside of bag 18 with bottom wall 20 overlying susceptor pad 30. Further, placement of susceptor pad 30 can occur at the material convertor or on the manufacturing lines.

Figure 3:
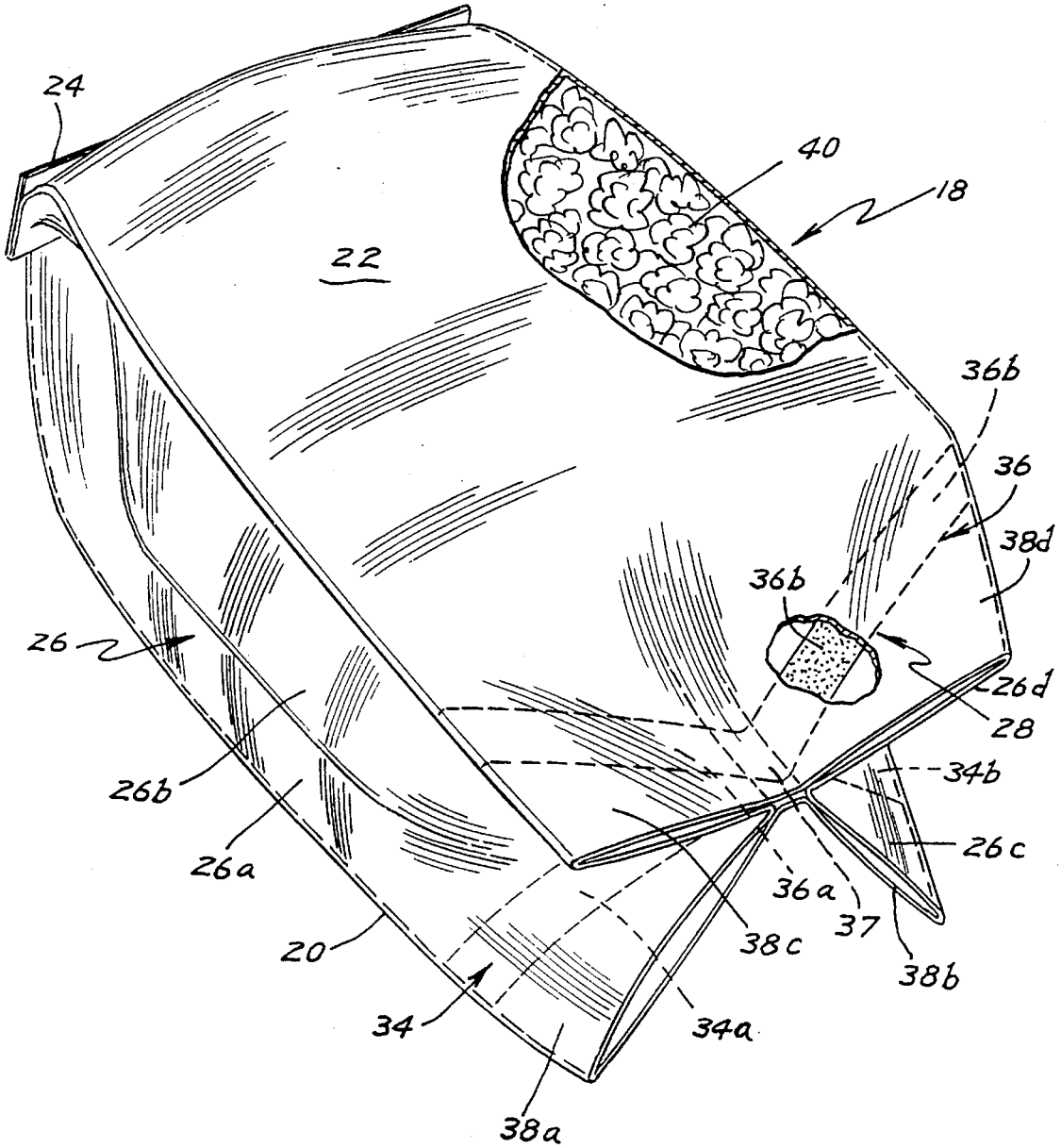
FIG. 3 shows a perspective view of the package of FIG. 1 in its expanded condition.
Figure 4:
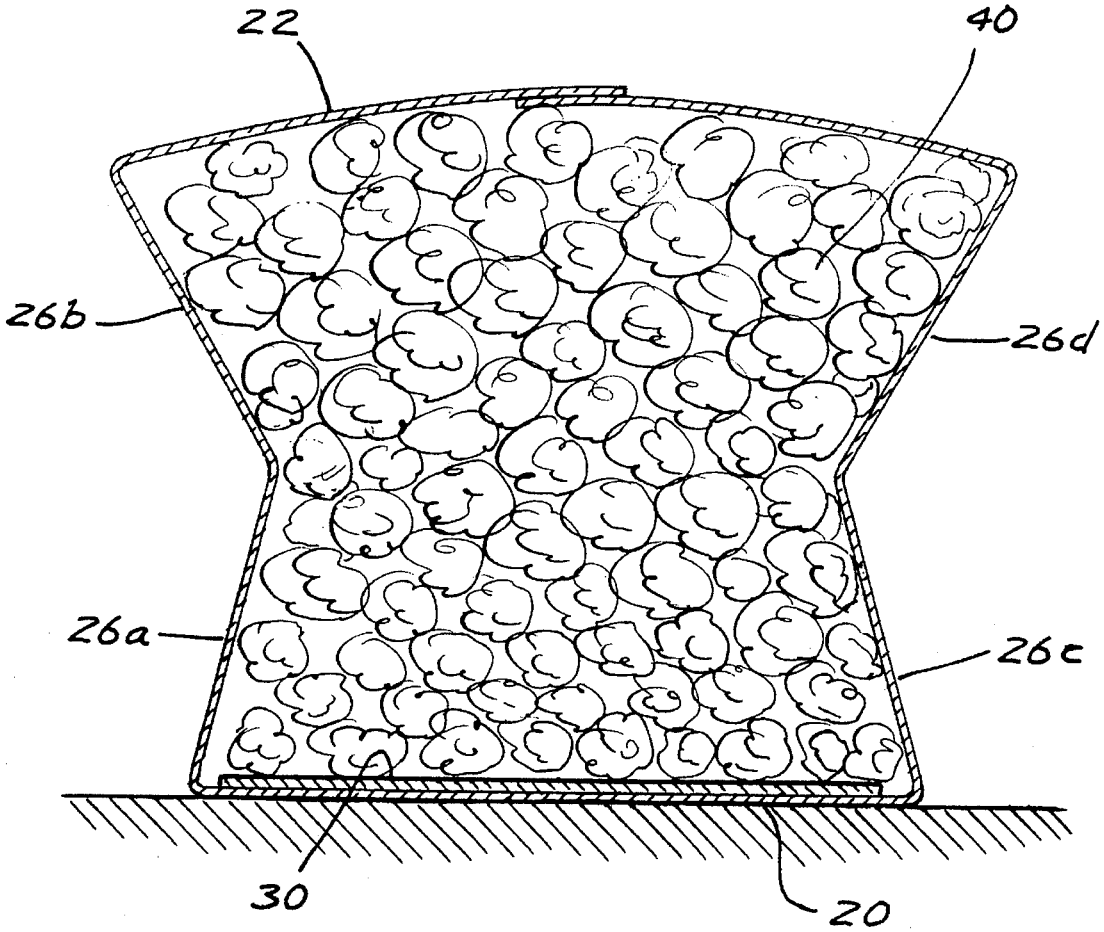
FIG. 4 shows a cross-sectional view of the package of FIG. 1 in a condition slightly prior to its expanded condition of FIG. 3.

It can then be appreciated that bag 18 can be manufactured as current bags are manufactured for example of the type shown and described in U.S. Pat. Nos. 4,450,180; 4,735,513; 4,878,765; 4,691,374; or 5,044,777. In this regard, bag 18 can be formed by cutting a web of material to length, folding that length of material to form the tubular bag stock including bottom, top, and side walls 20, 22, and 26, and then forming end wall 24 by folding and adhering bottom, top and side walls 20, 22, and 26. It should be noted that the overlapping edges of the web of material forming the tubular bag stock has been omitted in FIGS. 1–3 for ease of illustration. It should also be noted that the free, second ends of bottom, top, and side walls 20, 22, and 26 are all of the same length and specifically do not require any special cuts and/or do not require extra components to form tabs or flaps.

It can further be appreciated that bag 18 can be filled with the desired food product as current bags are filled for example of the type shown and described in U.S. Pat. No. 4,450,180. After filling, strips 34 and 36 can be adhered to walls 20, 22, and 26 utilizing standard equipment presently utilized to form the peelable seal of current bags. It of course should be appreciated that the particular manner of manufacture and filling of bag 18 can be done in a variety of ways and manners such as but not limited to the example set forth above.

For the sake of completeness, it will be assumed that the contents of bag 18 are popcorn kernels and the popped kernels have been generally indicated by the reference numeral 40, having been popped when in the microwave oven. Particularly, as with current bags, bag 18 in a collapsed condition is placed in a microwave oven with bottom wall 20 resting upon the bottom surface of the oven cavity. When subjected to microwave energy, susceptor pad 30 converts microwave energy into heat, with the heat and remaining microwave energy causing the popping of the kernels and the creation of water vapor. The water vapor and heated air cause side walls 26 to expand to extend from their connecting edges at an angular relation to each other and the inside surfaces of pleats 26*a*, 26*b*, 26*c*, and 26*d* being spaced from the inside surfaces of bottom and top walls 20 and 22, expanding bag 18 and increasing the interior volume inside of bag 18 for popped kernels 40. It can then be appreciated that due to its flexible nature, bag 18 will expand to a football like shape, including separating pleats 26*a* and 26*b* and pleats 26*c* and 26*d* adjacent to the second ends of bottom, top and side walls 20, 22, and 26.

According to the most preferred teachings of the present invention, bag 18 is formed of a single layer of greaseproof paper having a thickness allowing the single layer to be flexed by the popping of the popcorn kernels and also providing adequate greaseproof properties in storage, transportation, or cooking throughout the thickness of the paper to prevent wicking and leaking of grease or oil through the single layer. It has been discovered that by the selection of raw fibers as well as highly refining the raw fibers in the process of making the paper, the fibers themselves in the paper are resistant to grease staining and gives the paper greaseproof properties even when folded or creased. Particularly, the highly refined fibers have less tendency to fracture revealing uncoated fiber ends which absorb grease, but rather the bonds between the fibers tend to stretch, bend, or fracture and thus not revealing fractured fiber ends. Specifically raw fibers selected from the group of 100% chemical softwood pulp such as 100% bleached Kraft softwoods and which are highly refined to a freeness level in the order of 150 to 250 cubic centimeters have been found to provide adequate greaseproof properties when formed into paper having a basis weight of 11.5 kg. (25 lb.)/ream to 20.5 kg. (45 lb.)/ream and in the most preferred form in the order of 16 kg. (35 lb.)/ream. In the most preferred form, bag 18 is formed of a single layer of paper, Code No. 220-3510 produced by Rhinelander Paper Company, 515 W. Davenport Street, Rhinelander, Wis. 54501.

Consequently, with the foregoing description in mind, it should now be apparent that bag 18 according to the teachings of the present invention is much more flexible than current conventional popcorn bags because of its single layer and elimination of the laminating adhesive. Further, benefits of the single layer of paper softening during microwave cooking due to heat and steam give bag 18 more flexibility and less stiffness. Due to this increased flexibility, bag 18 according to the preferred teachings of the present invention inflates or expands from its collapsed, storage condition to an inflated or expanded condition having a larger interior volume than the same size current conventional popcorn bags, with bag 18 of the present invention allowing the popped kernels to pop with greater volume.

It can further be appreciated that the single layer forming bag 18 according to the teachings of the present invention provides economic advantages over current multilaminate popcorn bags by reducing the amount of paper material used for each bag 18 and also by eliminating the adhesive and the laminating steps required in multilaminate popcorn bags. Additionally, with the reduction in the amount of paper material used for each bag 18 and the elimination of the laminating adhesive, less package material in the form of garbage after the consumption of the popcorn is required to be disposed of resulting in environmental advantages over multilaminate popcorn bags.

When the amount of paper material utilized in the formation of bags 18 is minimized, whether of a multilaminate and especially of a single-ply construction, the consistent prevention of grease wicking and actual leaking in the fold or creased areas is a problem. Bag 18 according to the most preferred teachings of the present invention provides an added option of provisions for built-in grease leak protection at the creases. Particularly, in the most preferred form, grease protectors 42*a*, 42*b*, 42*c*, and 42*d* are provided located inside of bag 18 for sealing bottom wall 20 to pleat 26*a*, top wall 22 to pleat 26*b*, bottom wall 20 to pleat 26*c*, and top wall 22 to pleat 26*d*, respectively, adjacent to their respective connecting edges, with grease protectors 42*a*, 42*b*, 42*c*, and 42*d* sticking or joining the inside surfaces of bottom wall 20 to pleat 26*a*, top wall 22 to pleat 26*b*, bottom wall 20 to pleat 26*c*, and top wall 22 to pleat 26*d*, respectively, together adjacent to their respective connecting edges. Further, in the most preferred form, grease protectors 44*a* and 44*b* are provided located outside of bag 18 for sealing pleat 26*a* to pleat 26*b* and pleat 26*c* to pleat 26*d*, respectively, adjacent to their respective connecting edges, with grease protectors 44*a* and 44*b* sticking or joining the outside surfaces of pleat 26*a* to pleat 26*b* and pleat 26*c* to pleat 26*d*, respectively, together adjacent to their respective connecting edges. In the most preferred form, grease protectors 42*a*, 42*b*, 42*c*, 42d, 44*a* and 44*b* are applied during the printing process in the form of strips of preapplied heat seal adhesive on one or both sides of the connecting edges or of strips of preapplied cohesive on both sides of the connecting edges, such as Duraset 12, or equivalent.

Grease protectors 42*a*, 42*b*, 42*c*, 42*d*, 44*a* and 44*b* are selected to actually seal the paper forming bag 18 together just above and adjacent the connecting edges. Grease protectors 42*a*, 42*b*, 42*c*, and 42*d* actually block the flow of grease to the folded or creased areas of the connecting edges, and grease protectors 44*a* and 44*b* block the flow of grease away from the folded or creased areas of the connecting edges, thus preventing grease wicking or leaking. Further, in the preferred form, the adhesive or cohesive forming grease protectors 42*a*, 42*b*, 42*c*, 42*d*, 44*a* and 44*b* is selected to release or peel during expansion or inflation of bag 18 during microwave cooking such that the expanded or inflated volume of bag 18 will not be reduced utilizing grease protectors 42*a*, 42*b*, 42*c*, 42*d*, 44*a* and 44*b* from the expanded or inflated volume of bag 18 not utilizing grease protectors 42*a*, 42*b*, 42*c*, 42*d*, 44*a* and 44*b*.

It can then be appreciated that grease protectors 42*a*, 42*b*, 42*c*, 42*d*, 44*a* and 44*b* according to the teachings of the present invention provide an added grease barrier at the folded and creased areas where grease wicking and leaking are especially a problem, with grease protectors 42*a*, 42*b*, 42*c*, 42*d*, 44*a*, and 44*b* allowing minimization of the material and/or number of layers forming bag 18 where grease wicking and leaking are not such a problem.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Package for holding a food product including grease or oil and for heating in a microwave oven comprising, in combination: a flexible bag including a bottom wall, a top wall, and at least a first side wall extending between the top and bottom walls, with the top, bottom and side walls including first and second ends, with the first side wall including first and second pleats with the pleats being connected together at first edges and with the first pleat having a second, opposite edge connected to the bottom wall and the second pleat having a third, opposite edge connected to the top wall, with the bag further including an end wall at the first ends of the top, bottom and side walls; susceptor means for converting microwave energy into heat extending over a portion of the bottom wall spaced from the first and second ends of the bottom wall; means for closing the second ends of the top, bottom, and side walls and for allowing the consumer to open the package after microwave cooking; first means inside of the bag joining the first pleat to the bottom wall adjacent to the second edge; and second means inside of the bag joining the second pleat to the top wall adjacent to the third edge, with the first and second joining means preventing the grease or oil from leaking or wicking from inside the bag through the edges.

2. The package of claim 1 wherein the joining means are peelable during microwave cooking.

3. The package of claim 2 wherein the joining means comprise adhesive or cohesive applied adjacent to the edges.

4. The package of claim 3 wherein the bottom, top, and side walls are of paper having a thickness allowing the paper to be flexed by the microwave cooking of the food product.

5. The package of claim 4 wherein the bottom, top, and side walls are formed of a single layer of greaseproof paper which prevents wicking and leaking of the grease or oil through the single layer.

6. The package of claim 5 wherein the greaseproof paper is formed of raw fibers selected from the group of 100% chemical softwood pulp and which are highly refined, and having a basis weight in a range of about 25 lb./ream to 45 lb./ream.

7. The package of claim 3 wherein the bag includes a second side wall extending between the top and bottom walls opposite to the first side wall, with the second side wall including at least third and fourth pleats, with the third and fourth pleats being connected together at fourth edges and with the third pleat having a fifth, opposite edge connected to the bottom wall and the fourth pleat having a sixth, opposite edge connected to the top wall; third means inside of the bag joining the third pleat to the bottom wall adjacent to the fifth edge; fourth means inside of the bag joining the fourth pleat to the top wall adjacent to the sixth edge; and means outside of the bag joining the third pleat to the fourth pleat adjacent to the fourth edges.

8. The package of claim 1 further comprising, in combination: means outside of the bag joining the first pleat to the second pleat adjacent to the first edges.

9. Package for holding a food product including grease or oil comprising, in combination: an expandable bag having an interior volume for holding the food product and the grease or oil and including at least first and second walls connected together at first edges, with each of the first and second walls having first and second surfaces, with the bag having a collapsed condition and an expanded condition, with the interior volume of the bag increasing as the bag expands from the collapsed condition to the expanded condition, with the first and second walls being folded about the first edges with the first surfaces overlying each other in the collapsed condition, with the first and second walls extending from the first edges at an angular relation to each with the first surfaces being spaced from each other in the expanded condition; and means joining the first surfaces together adjacent to the first edges to prevent the grease or oil from leaking or wicking from the interior volume of the bag.

10. The package of claim 9 wherein the joining means is peelable as the bag expands from the collapsed condition to the expanded condition.

11. The package of claim 10 wherein the joining means comprise adhesive or cohesive applied to one or both of the first surfaces of the first and second walls adjacent to the first edges.

12. The package of claim 10 wherein the first surfaces are inside of the bag.

13. The package of claim 10 wherein the first surfaces are outside of the bag.

14. The package of claim 10 wherein the bag is sealed, wherein the bag expands from the collapsed condition to the expanded condition during cooking of the food product including the grease or oil.

15. The package of claim 9 wherein the first and second walls have a flexibility allowing flexing of the first and second walls by the microwave cooking of the food product.

16. The package of claim 15 wherein the first and second walls are formed of a single layer of greaseproof paper which prevents wicking and leaking of the grease or oil through the single layer.

17. The package of claim 16 wherein the greaseproof paper is formed of raw fibers selected from the group of 100% chemical softwood pulp and which are highly refined, and having a basis weight in a range of about 25 lb./ream to 45 lb./ream.

18. Expandable, paper, popcorn package for holding popcorn kernels and grease or oil for popping in a microwave oven comprising, in combination: a bag having an interior volume and a closed end openable by a consumer after microwave cooking; and susceptor means for converting microwave energy into heat extending over a portion of the bag, with the popcorn kernels and the grease or oil generally overlying the susceptor means during microwave cooking; and wherein the bag is formed of a single layer of greaseproof paper having a thickness allowing the single layer to be flexed by the popping of the popcorn kernels and also preventing the wicking and leaking of the grease or oil through the single layer.

19. The popcorn package of claim 18 wherein the greaseproof paper is formed of raw fibers which are highly refined.

20. The popcorn package of claim 19 wherein the single layer has a basis weight in the order of 35 lb./ream.

21. The popcorn package of claim 20 wherein the raw fibers are selected from the group of 100% chemical softwood pulps.

22. The popcorn package of claim 18 wherein the greaseproof paper is formed of raw fibers selected from the group of 100% chemical softwood pulps.

* * * * *